United States Patent [19]

Yamada et al.

[11] Patent Number: 4,931,107

[45] Date of Patent: Jun. 5, 1990

[54] PROCESS FOR PRODUCING A COLD ROLLED STEEL SHEET HAVING A GOOD AGEING RESISTANCE BY CONTINUOUS ANNEALING

[75] Inventors: Teruaki Yamada; Toshiyasu Ukena, both of Himeji; Osamu Akisue, Sagamihara; Kenji Kawai, Himeji; Yuuji Sano, Himeji; Teruki Hayashida, Himeji, all of Japan

[73] Assignee: Nippon Steel Corporation, Tokyo, Japan

[21] Appl. No.: 314,925

[22] Filed: Feb. 24, 1989

[30] Foreign Application Priority Data

Sep. 28, 1988 [JP] Japan ..... 63-243470

[51] Int. Cl.[5] ..... C21D 8/02

[52] U.S. Cl. ..... 148/12.3; 148/12 F

[58] Field of Search ..... 148/12.3, 12 F, 12 C

[56] References Cited

FOREIGN PATENT DOCUMENTS 58-10447 2/1983 Japan .
58-39890 9/1983 Japan .
60-52527 3/1985 Japan .
61-276935 12/1986 Japan .

*Primary Examiner*—Deborah Yee
*Attorney, Agent, or Firm*—Wenderoth, Lind & Ponack

[57] ABSTRACT

A cold rolled steel sheet having a good ageing resistance is produced by subjecting a cold rolled steel sheet to continuous annealing including recrystallization, grain growth, quenching, supercooling, reheating and overageing according to inclinatory cooling, where after the recrystallization and the grain growth, the steel sheet is quenched at a cooling rate of 50 to 250° C./sec from 720–600° C. to 200–310° C.; after retaining the steel sheet at the same temperature for 0 to 15 seconds, the steel sheet is reheated by at least 40° C. up to 320–400° C.; then the steel sheet is retained at the same temperature or cooled at a rate of not more than 0.7° C./sec including the time for retaining the steel sheet at the same temperature; and then the steel sheet is cooled at an average cooling rate of not more than 10° C./sec in a temperature zone of higher than 350° C., at a specific average cooling rate in a temperature zone of 350° C. to 300° C. and at a specific average cooling rate down to 285–220° C. in a temperature zone of lower than 300° C.

3 Claims, 4 Drawing Sheets

PROCESS FOR PRODUCING A COLD ROLLED STEEL SHEET HAVING A GOOD AGEING RESISTANCE BY CONTINUOUS ANNEALING

BACKGROUND OF THE INVENTION

1. Technical Field

This invention relates to a process for producing a cold rolled Al-killed steel sheet having an ageing resistance, which is equivalent to that obtained by box annealing, by continuous annealing including rapid heating and rapid quenching, particularly by utilizing a specific heat cycle for operations from the rapid quenching to the subsequent overageing. The term "sheet" means "sheet" or "plate" in the present specification and claims.

2. Description of the Prior Art

Box annealing has been so far an ordinary procedure for annealing a cold rolled steel sheet for working, but recently the cold rolled steel sheets are often produced by continuous annealing owing to remarkable quality and economical merits of the continuous annealing.

However, the continuous annealing has such a serious disadvantage that no satisfactory ageing resistance can be given to Al-killed steel, and thus the remarkable quality and economical merits of the continuous annealing have not been fully obtained in the case of the Al-killed steel up to now.

Several attempts have been so far made to improve the ageing resistance of Al-killed steel. For example, it has been proposed to improve the ageing resistance by devising a heat cycle for operations from quenching down to overageing by the following prior arts: Japanese Patent Publication No. 58-10447 disclosing a horizontal overageing process, in which the steel sheet reheated after the supercooling is retained at the same temperature in an operation after the reheating and the relationship between the temperature and time in such an operation of retaining for overageing is expressed by a horizontal linear line; and the Japanese Patent Publication No. 58-39890 and Japanese Patent Application Kokai (Laid-Open) Nos. 60-52527 and 61-276935 disclosing an overageing process according to an inclinatory cooling, in which the temperature of the steel sheet reheated after the super-cooling is changed with the passage of time in an operation after the reheating or the subsequent retaining and the relationship between the temperature and time in such an operation of cooling for overageing is expressed by an inclinatory line. However, the proposed processes fail to economically produce a cold rolled steel sheet having a good ageing resistance, because the heat cycle concept as well as the heat cycle itself has defects.

SUMMARY OF THE INVENTION

If it is possible to produce a cold rolled steel sheet having a good ageing resistance by continuous annealing economically (for a shorter time), the production most of cold rolled steel sheets will be changed from the box annealing to the continuous annealing, thereby drastically improving the labor productivity, etc. and attaining a very large economical effect.

The present inventors have continuously made extensive experiments on the basis of the process disclosed by the present inventors in Japanese Patent Publication No. 58-10447 to study the phenomena during the overageing in detail and have found that, in order to produce a cold rolled steel sheet having a good ageing resistance by an overageing treatment for a shorter time, the following two conditions must be satisfied:

(1) it is necessary to carry out an overageing according to an inclinatory cooling in such a manner that cooling below 350° C. is carried out not by a linear inclinatory cooling of not more than 2° C./sec, which is expressed by an inclinatory linear line as shown in Japanese Patent Publication No. 58-39890, but by a two-stage-inclinatory cooling in which a cooling rate in the cooling below 350° C. is changed once and which is expressed by an inclinatory line changing its direction once on the way; and (2) the main conditions for the overageing according to the inclinatory cooling must not be restricted to the reheating temperature as shown in Japanese Patent Publication No. 58-39890, but must be rather interlocked with the quenching end temperature or the cooling rate of quenching before the supercooling.

The main tasks of the present process are (1) how to set conditions for the two-stage-inclinatory cooling below 350° C. in the overageing according to the inclinatory cooling in the foregoing finding (1), and (2) how to interlock the main conditions for the overageing according to the inclinatory cooling with the quenching end temperature or the cooling rate of quenching before the supercooling.

The present inventors have made extensive experiments on (1) how to set the conditions for the two-stage-inclinatory cooling below 350° C. in the overageing according to the inclinatory cooling in the foregoing finding (1), and (2) how to interlock the main conditions for the overageing according to the inclinatory cooling with the quenching end temperature and the cooling rate of quenching before the supercooling, in a process for producing a cold rolled steel sheet having a good ageing resistance by continuous annealing and have completed the present invention.

The foregoing object of the present invention can be attained by the following means;

(1) A process for producing a cold rolled steel sheet having a good ageing resistance by continuous annealing, which comprises hot rolling a steel essentially consisting of 0.010 to 0.06% by weight of C, 0.05 to 0.4% by weight of Mn, 0.002 to 0.025% by weight of S, not more than 0.10% by weight of P, 0.01 to 0.10% by weight of sol.Al, 0.0010 to 0.0060% by weight of N and the balance being iron and inevitable impurities, according to an ordinary hot rolling procedure, thereby making a hot rolled sheet, cold rolling the hot rolled sheet, thereby making a cold rolled sheet and subjecting the cold rolled sheet to continuous annealing including recrystallization, grain growth, quenching, supercooling, reheating and overageing according to the inclinatory cooling, where after the recrystallization and the grain growth, the steel sheet is quenched at a cooling rate ($\alpha$) of 50° to 250° C./sec from 720°-600° C. to a quenching end temperature ($T_E$) of 200°-310° C.;

after retaining the steel sheet at the same temperature for 0 to 15 seconds, the steel sheet is reheated by at least 40° C. up to a reheating temperature ($T_R$) of 320°-400° C.;

then the steel sheet is retained at the same temperature for $t_1$ seconds defined by the following formula (1)

or is cooled at a rate of not more than 0.7° C./sec for $t_1$ seconds defined by the following formula (1); and then the steel sheet is cooled at an average cooling rate of not more than 10° C./sec in a temperature zone of not lower than 350° C., at an average cooling rate ($C.R_2$) defined by the following formula (2) in a temperature zone of 350° C., preferably lower than 350° C., to 300° C. and at an average cooling rate ($C.R_3$) defined by the following formula (3) down to 285°–220° C. in a temperature zone of not higher than 300° C., preferably lower than 300° C.:

$$t_s \leqq t_1 \leqq t_h + 20 \quad (1)$$

$$C.R_{2s} \leqq C.R_2 \leqq C.R_{2h} \quad (2)$$

$$C.R_{3s} \leqq C.R_3 \leqq C.R_{3h} \quad (3),$$

wherein:

$$t_s = \frac{1}{(-2.146 \times (1/\alpha) + 0.1211)} \times \exp(0.0130 \times T_E + 25024/(546 + T_R + T_{C1}) - 23.33)$$

$$T_h = \frac{1}{(-2.146 \times (1/\alpha) + 0.1211)} \times \exp(0.0130 \times T_E + 25024/(546 + T_R + T_{C1}) - 22.45)$$

$$C \cdot R_{2s} = (-2.983 \times (1/\alpha) + 0.168) \times \exp(-0.0130 \times T_E + 5.18)$$

$$C \cdot R_{2h} = (-4.185 \times (1/\alpha) + 0.263) \times \exp(-0.0130 \times T_E + 6.06)$$

$$C \cdot R_{3s} = (-0.695 \times (1/\alpha) + 0.0392) \times \exp(-0.0130 \times T_E + 5.18)$$

$$C \cdot R_{3h} = (-1.313 \times (1/\alpha) + 0.0741) \times \exp(-0.0130 \times T_E + 6.06)$$

$t_s$: minimum time for the inclinatory cooling retaining of the steel sheet at the same temperature, each of which is carried out after the reheating (sec)

$t_h$: maximum time for the inclinatory cooling or retaining of the steel sheet at the same temperature, each of which is carried out after the reheating (sec)

$\alpha$: cooling rate of quenching before the supercooling (°C./sec)

$T_E$: quenching end temperature (°C.)

$T_R$: reheating temperature (°C.)

$TC_1$: end temperature of the inclinatory cooling or retaining of the steel sheet at the same temperature, each of which is carried out after the heating (°C.)

$C.R_{2s}$: minimum average cooling rate in the zone of 350° C., preferably lower than 350° C., to 300° C. (°C./sec)

$C.R_{2h}$: maximum average cooling rate in the zone of 350° C., preferably lower than 350° C., to 300° C. (°C./sec)

$C.R_{3s}$: minimum average cooling rate in the zone of not higher than 300° C., preferably lower than 300° C. (°C./sec)

$C.R_{3h}$: maximum average cooling rate in the zone of not higher than 300° C., preferably lower than 300° C. (°C./sec).

(2) A process as described in (1), wherein the steel further contains B in a ratio of B/N of 0.5 to 2.0 by weight, whereby a softness and a good workability are given to the steel sheet.

(3) A process as described in (1) or (2), wherein the cooling rate ($\alpha$) of quenching before the supercooling is a rate of 80° to 250° C./sec.

DETAILED DESCRIPTION OF THE INVENTION

Figure 1:
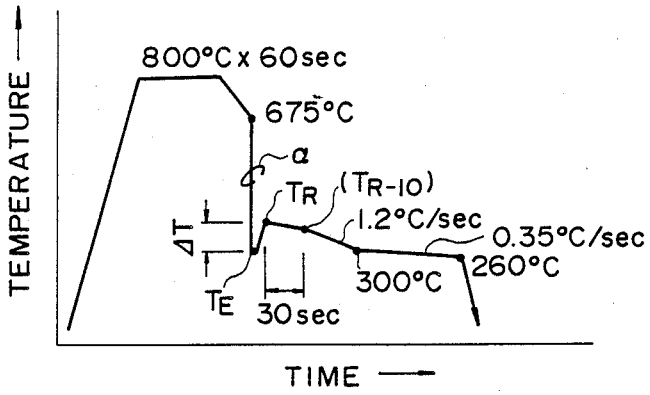
FIG. 1 is a diagram showing a heat cycle used in tests for determining the cooling rate before the super-cooling, quenching end temperature and width of reheating temperature according to the present invention.

The present invention will be described in detail below.

An Al-killed cold rolled steel sheet having a good ageing resistance, which can be produced by continuous annealing and which is an object of the present invention, is obtained in the following manner:

It is known that the ductility and deep drawing property are improved with decreasing C content and the ageing resistance is deteriorated with too decreased C content, and a cold rolled steel sheet having good workability and ageing resistance can be obtained with a C content of 0.010 to 0.06% by weight in the present invention.

Control of Mn and S is important in the present invention, and generally Mn is an element necessary for preventing the embrittlement induced by inevitably existing S at the time of hot rolling. In the present invention, MnS is utilized as a site for preferential precipitation of carbides, and thus some precipitation density is required for MnS. For this reason, Mn is controlled to 0.05 to 0.4% by weight and S is controlled to 0.002 to 0.025% by weight in the present invention, whereby the necessary number of MnS sites and nuclei for precipitation of necessary cementite for producing a cold rolled steel sheet having a good ageing resistance can be obtained.

P is an element having no significant influence upon the ageing resistance, but its upper limit is set to 0.10% by weight in case of producing a cold rolled steel sheet for automobiles, because the workability is considerably deteriorated, if the P content exceeds 0.10% by weight.

Sol.Al is a necessary element for controlling the oxygen and nitrogen contents of steel and its upper limit is set to 0.10% by weight because the steel turns hard when the sol.Al content is too high, whereas the lower limit is set to 0.01% by weight, because the ageing by N cannot be suppressed if the sol.Al content is too low.

N combines with sol.Al in the steel to form AlN (BN when the steel contains B), thereby hardening the steel.

Thus, the upper limit of the N content is set to 0.0060% by weight, whereas the lower limit is set to 0.0010% by weight, because it is difficult in the current steel-making technology to make the N content lower than 0.0010% by weight.

In the present invention, B is added to the steel, when required, and when B is contained in a ratio of B/N of 0.5 or higher, B combines with N in the steel to form BN, thereby preventing the ageing by nitrogen, whereas when B/N exceeds 2.0, the amount of solid solution B is increased to harden the steel. Thus, the lower limit of B is set to 0.5 in terms of B/N and the upper limit is set to 2.0.

In the present invention, operations from casting down to hot rolling can be carried out by cooling a slab and reheating it or by continuous casting and subsequent direct rolling (CC - DR). The slab heating temperature may be higher, but preferably is such a low temperature as about 1,000° to about 1,130° C. because of better MnS distribution, which is preferable for producing a cold rolled sheet having a good ageing resistance. The coiling temperature after the hot rolling gives no significant influence upon the ageing resistance and a satisfactory effect can be obtained in the present invention at an ordinary coiling carried out at a temperature of about 500° to about 600° C., but when the coiling is carried out at a higher temperature than 700° C., the crystal grain size becomes large after the cold rolling and the annealing and the workability is more preferably improved.

Description will be made of continuous annealing below.

Steps of heating a cold rolled steel sheet, thereby carrying out recrystallization and grain growth, are not particularly limited and can be carried out according to an ordinary procedure. That is, the cold rolled steel sheet is heated to higher than the recrystallization temperature and uniformly heated. After the uniform heating, the steel sheet must be quenched from 720°-600° C. down to 200°-310° C. at a cooling rate of 50°-250° C./sec, and the heat cycle from the quenching to the end of overageing is most important for producing a cold rolled steel sheet having a good ageing resistance, as desired in the present invention, and thus is an essential point of the present invention.

Description will be made of the cooling rate below.

The cooling rate is important for efficient overageing and is a necessary condition for ensuring a high degree of supersaturation of solid solution C before the overageing as a basis for high density precipitation of cementite necessary for achieving the overageing in a shorter time.

The effect of the cooling rate will be described below, referring to test results.

Cold rolled steel strips produced according to the present process, in which a steel having a steel composition as described above is formed into a hot rolled sheet according to an ordinary procedure, were tested for the ageing resistance according to the heat cycle shown in FIG. 1 by setting $T_E=260°$ C. and $T_R=350°$ C., while changing the cooling rate ($\alpha$). The results are shown in FIG. 2.

Figure 2:
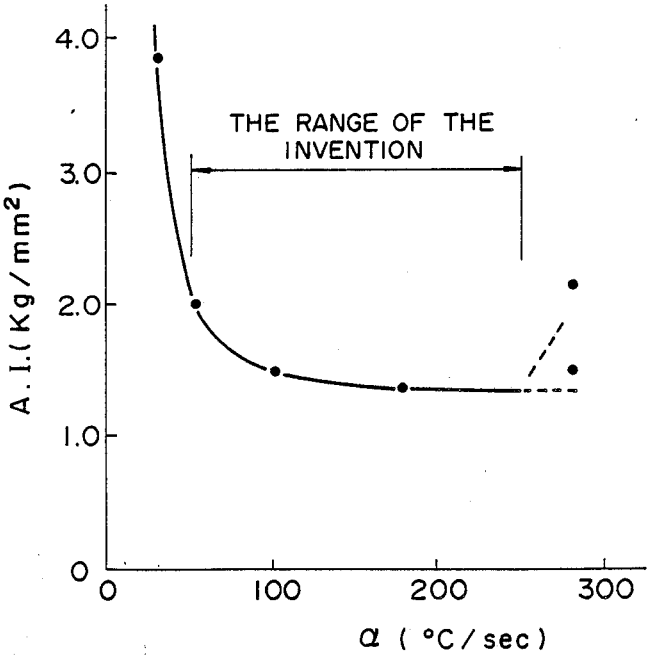
FIG. 2 is a diagram showing a relationship between the cooling rate before the supercooling and the ageing resistance.

As shown in FIG. 2, the ageing resistance greatly depends upon the cooling rate ($\alpha$), and in order to produce a cold rolled steel sheet having a good ageing resistance, the cooling rate ($\alpha$) must be set to 50° C./sec or higher, preferably 80° C./sec or higher. The upper limit must be set to 250° C./sec, because above 250°/sec, the control of the quenching end temperature becomes hard and the ageing property becomes unstable.

Description will be made of quenching end temperature below.

The quenching end temperature is important, because it determines the precipitation density of cementite, and makes it possible to attain the overageing for a shorter time. The quenching end temperature is also important, because it determines a heat cycle for the optimum overageing according to the inclinatory cooling as an essential condition for producing a cold rolled steel sheet having a good ageing resistance by overageing for a shorter time.

The effect of the quenching end temperature will be described below, referring to test results.

Cold rolled steel strips produced according to the present process were tested for the ageing resistance according to the heat cycle shown in FIG. 1 by setting $\alpha=100°$ C./sec and $T_R=350°$ C., while changing the quenching end temperature ($T_E$). The results are shown in FIG. 3.

Figure 3:
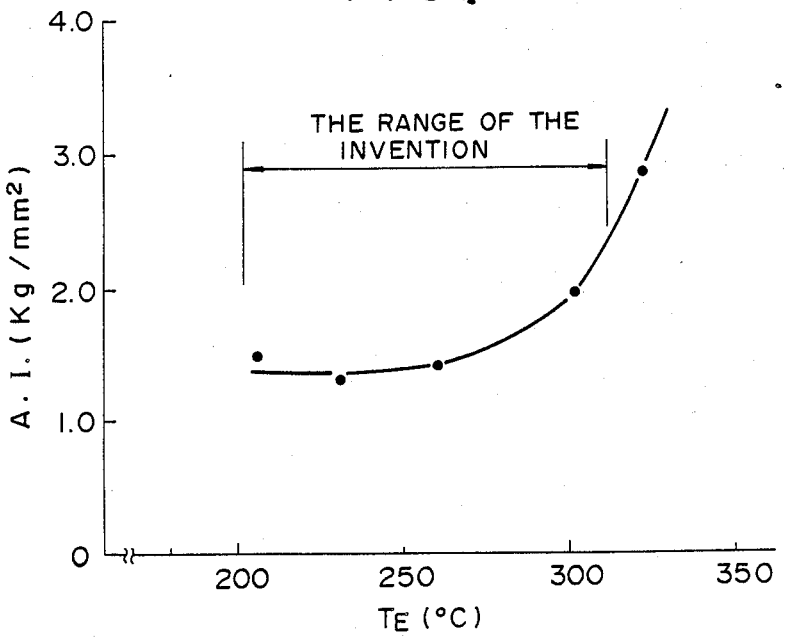
FIG. 3 is a diagram showing a relationship between the quenching end temperature and the ageing resistance.

As shown in FIG. 3, the ageing resistance greatly depends upon the quenching end temperature ($T_E$), and in order to produce a cold rolled steel sheet having a good ageing resistance, the quenching end temperature ($T_E$) must be set to not higher than 310° C., preferably to not higher than 300° C. The lower the quenching end temperature ($T_E$), the better the ageing property, but the precipitation density of cementite becomes too high, resulting in higher hardness, broader temperature fluctuation in each position of the inner part of a coil and broader fluctuation in the ageing property. Thus, the lower limit must be set to 200° C.

Time for retaining the steel sheet at the quenching end temperature will be described below.

Precipitation nuclei of cementite can be readily formed in the course of reheating without providing a time for retaining at the quenching end temperature. Retaining or cooling in the furnace around the quenching end temperature may be carried out, if required in view of the structure of the facility. A necessary and sufficient time for retaining the steel sheet at the $T_E$ temperature, as far as the facility for the reheating, in view of the structure of the facility, is 15 seconds, and retention for more than 15 seconds requires a longer structure and a higher investment for the facility. Thus, the upper limit must be set to 15 seconds.

The reheating rate will be described below.

The reheating rate has no influence upon the ageing resistance and thus may not be particularly limited. A heating system by a radiant tube at 10° C./sec or induction heating or electric resistance heating systems at 100° C./sec or both may be used. The rapid heating system by induction heating, etc. is better as a reheating means, because of higher reheating rate, shorter reheating time and better control of sheet temperature.

Description will be made of the width of reheating temperature below.

The width of reheating temperature ($\Delta T$) or the reheating temperature has a large influence upon the shortening of overageing treatment time. A higher reheating temperature can increase the rate of the diffusion of C necessary for the precipitation of cementite and shorten the overageing time.

The effect of the width of reheating temperature will be described below, referring to test results.

Cold rolled steel strips produced according to the present process were tested for the ageing resistance according to the heat cycle shown in FIG. 1 by setting $\alpha=100°$ C./sec and $T_E=260°$ C., while changing the width of reheating temperature ($\Delta T$). The results are shown in FIG. 4.

Figure 4:
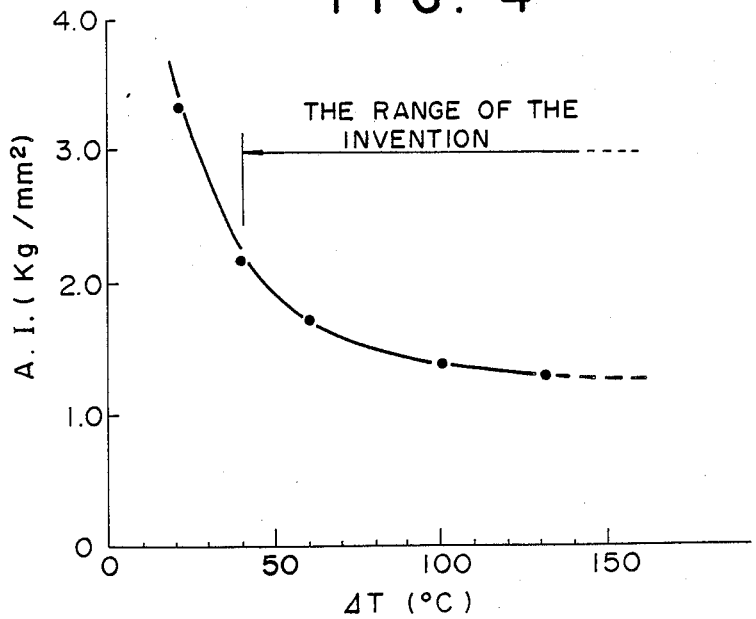
FIG. 4 is a diagram showing a relationship between the width of reheating temperature and the ageing resistance.

In order to produce a cold rolled steel sheet having a good ageing resistance, the lower limit of the width of reheating temperature must be set to 40° C., because no satisfactory ageing resistance can be obtained below 40° C., as shown in FIG. 4. Moreover, the lower limit of the reheating temperature is set to 320° C., because if the reheating temperature is lower than 320° C., the necessary rate of the diffusion of C cannot be obtained so that it becomes difficult to cause the effect of the overageing.

On the other hand, the upper limit of the reheating temperature must be set to 400° C., because even if the reheating is carried out above 400° C., the degree of improvement of the ageing resistance becomes small as compared with the energy cost required for the reheating. Above 450° C., the nuclei of the precipitated cementite undergo solid solution again and disappear, resulting in a failure to cause the effect of the overageing in the case that the overageing treatment is carried out for a shorter time. Thus, the reheating temperature must be set to lower than 450° C.

Description will be made of conditions for overageing according to the inclinatory cooling below.

The conditions for overageing according to the inclinatory cooling are important for the present process and have been found for the first time by the present inventors as a result of extensive studies on optimum conditions for overageing according to the inclinatory cooling. The most important point is how to set inclinatory cooling conditions below 350° C. in the overageing according to the inclinatory cooling. The next important point is how to set conditions for inclinatory cooling or retaining at the same temperature, each of which is carried out immediately after the reheating.

Description will be made below, referring to thermal histories.

At first, description will be made of conditions for inclinatory cooling or retaining at the same temperature, each of which is carried out immediately after the reheating.

The conventional process disclosed, for example, in Japanese Patent Publication No. 58-39890 very roughly sets forth the retaining time on the basis of the reheating temperature, but as a result of extensive studies, the present inventors have found that it is important to set the time for inclinatory cooling or retaining at the same temperature, each of which is carried out immediately after the reheating, as interlocked with the cooling rate of quenching before the supercooling, quenching end temperature, reheating temperature or inclinatory cooling end temperature after the reheating. Furthermore, it has been found that inclinatory cooling having an advantage on the energy saving can be carried out under the present process conditions, and it is not necessary to retain the steel sheet at the same temperature.

The effect will be described below, referring to test results.

Figure 5:
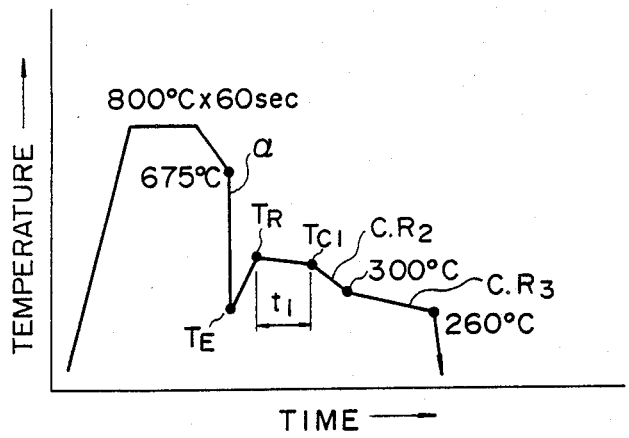
FIG. 5 and FIG. 7 are diagrams showing a heat cycle used in tests for determining the inclinatory cooling conditions after the reheating.
Figure 7:
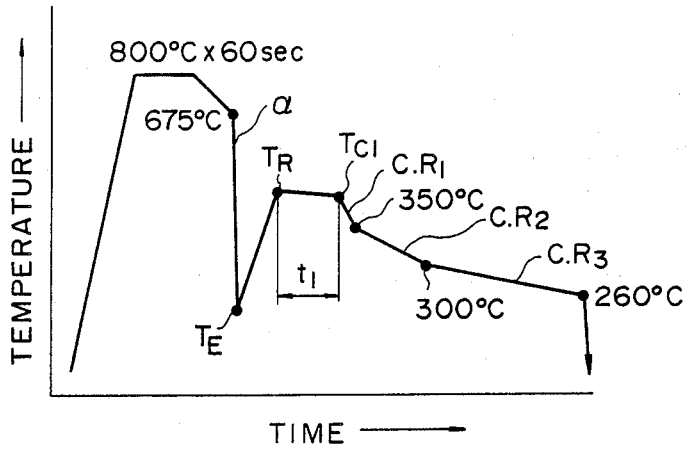

Cold rolled steel strips, produced in accordance with the composition and hot rolling conditions of steel I as shown in Table 3, were tested for the influence of time ($t_1$) for inclinatory cooling, each of which is carried out immediately after the reheating, upon the ageing resistance according to the heat cycle shown in FIG. 5 or FIG. 7 by changing conditions for overageing, as shown in Table 1. The results are shown in Table 1.

TABLE 1

| | Production conditions | | | | | | | | | Aging | Remarks | |
|---|---|---|---|---|---|---|---|---|---|---|---|---|
| Steel | $\alpha$ °C./sec | $T_E$ °C. | $T_R$ °C. | $T_{Cl}$ °C. | $t_1$ sec. | $C.R_1$ °C./sec. | $C.R_2$ °C./sec | $C.R_3$ °C./sec | Pressure control % | resistance A.I. kg/mm$^2$ | Range for $t_1$ of the Invention (sec) | |
| Steel 1 | 100 | 260 | 350 | 340 | 5 | — | 1.6 | 0.5 | 1.0 | 3.0 | 14~52 | Comparative |
| Steel 2 | 100 | 260 | 350 | 340 | 15 | — | 1.6 | 0.5 | 1.0 | 1.9 | 14~52 | The Invention |
| Steel 3 | 100 | 260 | 350 | 340 | 30 | — | 1.6 | 0.5 | 1.0 | 1.4 | 14~52 | The Invention |
| Steel 4 | 100 | 260 | 350 | 340 | 60 | — | 1.6 | 0.5 | 1.0 | 1.4 | 14~52 | Comparative |
| Steel 5 | 50 | 300 | 350 | 340 | 5 | — | 0.8 | 0.2 | 1.0 | 3.5 | 29~90 | Comparative |
| Steel 6 | 50 | 300 | 350 | 340 | 20 | — | 0.8 | 0.2 | 1.0 | 2.9 | 29~90 | Comparative |
| Steel 7 | 50 | 300 | 350 | 340 | 30 | — | 0.8 | 0.2 | 1.0 | 1.9 | 29~90 | The Invention |
| Steel 8 | 50 | 300 | 350 | 340 | 50 | — | 0.8 | 0.2 | 1.0 | 1.8 | 29~90 | The Invention |
| Steel A | 100 | 260 | 400 | 390 | 10 | 2 | 1.6 | 0.5 | 1.0 | 1.4 | 3~27 | The Invention |
| Steel B | 100 | 260 | 400 | 390 | 10 | 8 | 1.6 | 0.5 | 1.0 | 1.4 | 3~27 | The Invention |
| Steel C | 100 | 260 | 400 | 390 | 10 | 20 | 1.6 | 0.5 | 1.0 | 3.0 | 3~27 | Comparative |

Steel 1 relates to a comparative example showing that the time $t_1$ for inclinatory cooling as described in the column "Production conditions" of the Table 1 is below the lower limit of the range for $t_1$ of the invention as described in the column "Remarks" of the Table 1, and the ageing resistance is not better than those of steels 2 and 3 in which the time $t_1$ for inclinatory cooling is within the range for $t_1$ of the invention. Steels 5, 6, 7 and 8 are likewise tested for the influence of the inclinatory cooling time $t_1$ by changing ($\alpha$) (cooling rate of quenching before the supercooling) and $T_E$ (quenching end temperature), where steels 5 and 6 relate to comparative examples showing that the inclinatory cooling time $t_1$ is below the lower limit of the range for $t_1$ of the invention. The inclinatory cooling time $t_1$ of steel 5 is 5 seconds which is greatly lower than the lower limit (29 seconds) of the range for $t_1$ of the invention, and the ageing resistance thereof is extremely deteriorated because the ageing index (A.I.) is 3.5 kg/mm$^2$. And the inclinatory cooling time $t_1$ of steel 6 is 20 seconds which is outside the range (29~90 seconds) for $t_1$ of the invention in the case that the cooling rate ($\alpha$) is 50° C./sec as shown in the Table 1, but if the cooling rate ($\alpha$) of steel 6 is 200° C./sec, 20 seconds of the inclinatory cooling time $t_1$ is within the range for $t_1$ of the invention, as calculated from the foregoing equation (1). The ageing resistance of steel 6 is deteriorated because A.I. is 2.9 kg/mm$^2$. As clearly understood from A.I. of steel 6, it has a great effect to limit the inclinatory time $t_1$ by the foregoing equation (1). Steels 7 and 8 are examples of the present invention and show good A.I. of the ageing resistance.

The upper limit of the inclinatory cooling rate carried out immediately after the reheating is set to 0.7° C./sec, because above 0.7° C./sec, the ageing resistance is deteriorated. Furthermore, the lower limit of the time for inclinatory cooling or retaining at the same temperature, each of which is immediately after the reheating, is set to $t_s$ because below the lower limit $t_s$ of formula (1), the ageing resistance is deteriorated. The upper limit is set to $t_h+20$ seconds, because even if the upper limit is higher than $t_h$ of formula (1), the effect upon the improvement of the ageing resistance is saturated, resulting in a larger time loss.

Description will be made below of conditions for inclinatory cooling as the most important point of the present invention.

The present inventors have studied various conditions for inclinatory cooling and have found that the conditions for inclinatory cooling must be set in view of the facts that (1) the inclinatory cooling must be carried out in three stage temperature zones and each stage temperature zone has an optimum cooling rate and (2) the cooling rate in each individual stage cooling zone greatly depends upon the cooling rate ($\alpha$) before the supercooling and the quenching end temperature ($T_E$).

It has been further found that the first point of (1) the inclinatory cooling in the three stage temperature zones can be carried out most effectively by dividing inclinatory cooling following the inclinatory cooling or retaining at the same temperature, each of which is carried out immediately after the reheating, into such three stage temperature zones as a temperature zone of not lower than 350° C., a temperature zone of 350° C., preferably lower than 350° C., to 300° C. and a temperature zone of not higher than 300° C., preferably below 300° C.

The next point of (2) optimum conditions for the cooling rate in the individual stage temperature zones will be explained below from one temperature zone to another individually.

When the inclinatory cooling is carried out in the temperature zone of not lower than 350° C., it is not necessary to select a specially suitable inclinatory cooling rate for a given steel. It has been found that a cooling rate of not more than 10° C./sec is satisfactory for the steel produced according to the present process.

The effect of the inclinatory cooling in the temperature zone of not lower than 350° C. will be described below, referring to test results.

Cold rolled steel strips (steels A, B and C shown in Table 1) produced according to the present process were subjected to the overageing treatment according to the heat cycle shown in FIG. 7 by changing conditions for overageing, as shown in Table 1, and were tested for the ageing resistance. The results are shown in Table 1. Steels A and B have good ageing resistance because their $C.R_1$ in Table 1 shows 2° C./sec and 8° C./sec, respectively, which are within the range (not more than 10° C./sec) of the cooling rate of the present process. On the other hand, steel C in Table 1 shows that its $C.R_1$ is 20° C./sec, which exceeds the upper limit of the cooling rate of the present process, and its A.I. is 3.0 kg/mm$^2$, so the ageing resistance of steel C is deteriorated. As understood from the above results, it has been found that the cooling rate in the temperature zone of not lower than 350° C. may be not more than 10° C./sec.

The conditions for inclinatory cooling from lower than 350° C. will be given below. How to set the conditions for inclinatory cooling from lower than 350° C. in two stage temperature zones is important for the present invention. The present inventors have made extensive tests and have found that the rate of decreasing the solid solution C at the inclinatory cooling from lower than 350° C. in two stage temperature zones greatly depends upon the density of precipitated cementite, and that the precipitation density of cementite greatly depends only upon the quenching end temperature ($T_E$) and the cooling rate ($\alpha$) of quenching before the supercooling, and have succeeded in establishing quantitative relationships between these factors The effect of the inclinatory cooling in the two stage temperature zones will be described below, referring to test results.

Cold rolled steel strips produced according to the present process were tested for the influences of the average cooling rate ($C.R_2$) in the temperature zone of 350° C. to 300° C. and the average cooling rate ($C.R_3$) in the temperature zone of not more than 300° C. upon the ageing resistance according to the heat cycle shown in FIG. 5 by changing conditions for overageing treatment of Table 2. The results are shown in Table 2.

TABLE 2

| | Production conditions | | | | | | | | Aging resistance | Remarks: Ranges of the Invention | | Remarks |
|---|---|---|---|---|---|---|---|---|---|---|---|---|
| Steel | $\alpha$ °C./sec | $T_E$ °C. | $T_R$ °C. | $T_{Cl}$ °C. | $t_1$ sec | $C.R_2$ °C./sec | $C.R_3$ °C./sec | Pressure control % | A.I. kg/mm$^2$ | $C.R_2$ (°C./sec) | $C.R_3$ (°C./sec) | |
| Steel 9 | 100 | 260 | 350 | 340 | 30 | 1.6 | 1.6 | 1.0 | 2.5 | 0.8~2.8 | 0.2~0.9 | Comparative |
| Steel 10 | 100 | 260 | 350 | 340 | 30 | 1.6 | 0.5 | 1.0 | 1.4 | 0.8~2.8 | 0.2~0.9 | The Invention |
| Steel 11 | 100 | 290 | 350 | 340 | 25 | 1.2 | 1.2 | 1.0 | 3.2 | 0.6~1.9 | 0.1~0.6 | Comparative |
| Steel 12 | 100 | 290 | 350 | 340 | 25 | 1.2 | 0.3 | 1.0 | 1.6 | 0.6~1.9 | 0.1~0.6 | The Invention |
| Steel 13 | 200 | 230 | 350 | 340 | 15 | 2.0 | 0.7 | 1.0 | 1.4 | 1.3~4.6 | 0.3~1.5 | The Invention |
| Steel 14 | 50 | 310 | 350 | 340 | 45 | 2.0 | 0.7 | 1.0 | 3.8 | 0.4~1.3 | 0.1~0.4 | Comparative |

Steels 9 and 11 relate to comparative examples according to the process disclosed in Japanese Patent Publication No. 58 - 39890, where not a two-stage-inclinatory cooling but a linear inclinatory cooling, expressed by a straight line, is carried out at 1.6° C./sec or 1.2° C./sec for both $C.R_2$ and $C.R_3$, respectively, and their ageing resistances (A.I.) are considerably worse than those of steels 10 and 12 of the present invention.

Steels 13 and 14 relate to examples of a two-stage inclinatory cooling carried out at 2.0° C./sec for $C.R_2$ and 0.7° C./sec for $C.R_3$, where steel 14 is a comparative example exceeding the upper limits of the present invention for both $C.R_2$, and $C.R_3$, and its ageing resistance is considerably worse than that of steel 13 according to the present invention where the two-stage inclinatory cooling is carried out at $C.R_2$ and $C.R_3$ within the ranges of the present invention.

As described in detail above, referring to the test results, it has been found that the inclinatory cooling following the inclinatory cooling or retaining at the same temperature, each of which is carried out immediately after the reheating, must be carried out at an average cooling rate of not more than 10° C./sec in the temperature zone of not lower than 350° C., at an average cooling rate ($C.R_2$) defined by formula (2) in the temperature zone of 350° C., preferably lower than 350° C., to 300° C. and further at an average cooling rate ($C.R_3$) defined by formula (3) in the temperature zone of not higher than 300° C., preferably lower than 300° C., to 285° C.–220° C. (inclinatory cooling end temperature).

$$C.R_{2s} \leqq C.R_2 \leqq C.R_{2h} \quad (2)$$

$$C.R_{3s} \leqq C.R_3 \leqq C.R_{3h} \quad (3)$$

wherein:

$$C \cdot R_{2s} = (-2.983 \times (1/\alpha) + 0.168) \times \exp(-0.0130 \times T_E + 5.18)$$

$$C \cdot R_{2h} = (-4.185 \times (1/\alpha) + 0.263) \times \exp(-0.0130 \times T_E + 6.06)$$

$$C \cdot R_{3s} = (-0.695 \times (1/\alpha) + 0.0392) \times \exp(-0.0130 \times T_E + 5.18)$$

$$C \cdot R_{3h} = (-1.313 \times (1/\alpha) + 0.0741) \times \exp(-0.0130 \times T_E + 6.06).$$

Description will be made of the inclinatory cooling end temperature below.

The inclinatory cooling end temperature is selected in view of the desired ageing resistance. When a cold rolled steel sheet having an ageing resistance, such that A.I. is not more than 3 kg $mm^2$, is produced, cooling to about 280° C. is satisfactory. When a cold rolled steel sheet having a much better ageing resistance, for example, A.I. of not more than 2 kg/$mm^2$, is produced, cooling to about 260° C. is satisfactory. Needless to say, further cooling can somewhat improve the ageing resistance, but the efficiency of ageing resistance improvement is not so better against increased overageing treatment time. Thus, the lower limit of the inclinatory cooling end temperature must be 220° C. and the upper limit must be 285° C.

Cooling after the cooling for the inclinatory overageing can be carried out through slow cooling to 200° C. or lower by a gas jet, etc., followed by quenching so as to obtain a good shaped steel sheet, or otherwise through quenching from the inclinatory cooling end temperature.

As described in detail above, the present invention provides a distinguished continuous annealing process for producing a cold rolled steel sheet having a good ageing resistance and thus has a good economical effect.

The necessary facility for carrying out the present invention requires a quenching apparatus using cooling gas or water after the uniform heating as a prerequisite. After the quenching, the reheating is carried out by induction heating, electric resistance heating or atmospheric heating, and the successive overageing according to the inclinatory cooling is carried out through multi-stage-inclinatory cooling zones while precisely controlling the temperatures of the inclinatory cooling zones.

PREFERRED EMBODIMENTS OF THE INVENTION

The effect of the present invention will be described in detail below, referring to an Example

EXAMPLE

Figure 6:
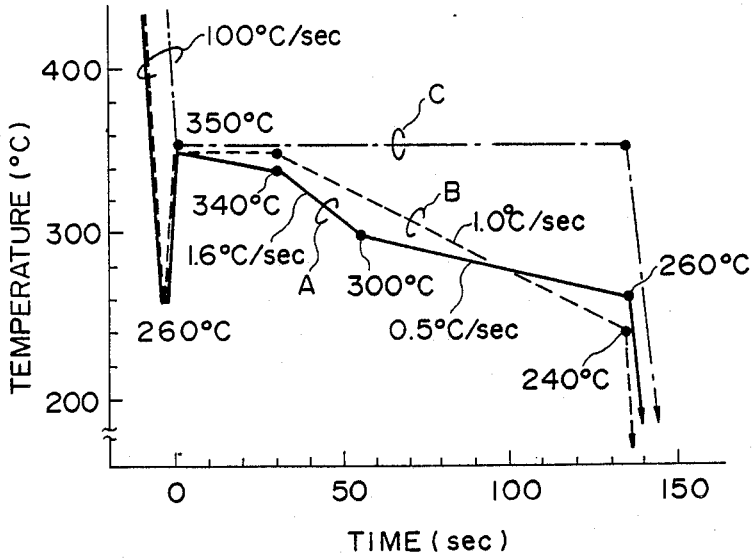
FIG. 6 is a diagram showing heat cycles for inclinatory cooling according to Examples of the present invention and Comparative Examples.

Hot rolled steel strips produced under the production conditions shown in Table 3 were cold rolled at a draft of 80% to obtain a thickness of 0.8 mm, continuously annealed according to the heat cycle shown in FIG. 6 and subjected to 1.0% refining rolling to investigate the quality of the materials. The results of the investigation are shown in Table 4.

Test steels I, II and III all relate to the hot rolled steel strips produced according to the present process, where steel I is a low carbon Al-killed steel for deep drawing (DDQ), steel II is a B-containing, low carbon Al-killed steel for working (DQ) and steel III is a P-containing, high tension steel for drawing working of 35 kg class (which means a range of 35 to 38 kg/$mm^2$ of tensile strength).

Steels IA, IIA, IIIA relate to embodiments of the present invention, where test steels I, II and III were treated according to the continuous annealing heat cycle A of the present invention shown in FIG. 6.

Steels IB, IIB and IIIB relate to comparative examples, where the test steels I, II and III were treated according to the cycle B shown in FIG. 6, which corresponds to the process disclosed in Japanese Patent Publication No. 58 - 39890, respectively.

Steels IC, IIC and IIIC relate to comparative examples, where the test steels I, II and III were treated according to the heat cycle C shown in FIG. 6, which corresponds to isothermal overageing without supercooling, so far usually employed.

Steels IA, IIA and IIIA show high tension steel sheets having a good ageing resistance for deep drawing (DDQ), working (DQ) and drawing working of 35 kg class, respectively.

On the other hand, steels IB, IIB and IIIB show cold rolled steel sheets having no better ageing resistance, and it is obvious that according to the process disclosed in Japanese Patent Publication No. 58 - 39890, where the inclinatory cooling from 350° C. is carried out in the form of an inclinatory straight line, it is hard to produce a cold rolled steel sheet having a good ageing resistance, as desired in the present invention, by continuous annealing. Steels IC, IIC and IIIC have a poor ageing resistance and it is thus obvious that it is hard to produce a cold rolled steel sheet having a good ageing resistance by the conventional isothermal overageing without any supercooling.

TABLE 3

| Steel | Composition (%) < Hot rolled sheet > C | Si | Mn | P | S | sol.Al | N | B | Hot rolling conditions (°C.) HST | F.T | C.T | Remarks |
|---|---|---|---|---|---|---|---|---|---|---|---|---|
| Steel I | 0.020 | 0.01 | 0.12 | 0.010 | 0.007 | 0.050 | 0.0035 | Tr | 1070 | 905 | 690 | The Invention |
| Steel II | 0.019 | 0.01 | 0.17 | 0.014 | 0.009 | 0.031 | 0.0015 | 0.0017 | 1100 | 910 | 630 | The Invention |
| Steel III | 0.025 | 0.01 | 0.20 | 0.070 | 0.010 | 0.042 | 0.0031 | Tr | 1150 | 890 | 700 | The Invention |

The term "HST" means Hot Soaking Temperature.

TABLE 4

| Steel | Production condition: Test steel | Heat cycle | Mechanical properties: Y.P. kg/mm² | T.S. kg/mm² | Elongation (%) | A.I. kg/mm² | $\bar{\gamma}$ | Remarks |
|---|---|---|---|---|---|---|---|---|
| Steel IA | Steel I | A | 17.8 | 31.4 | 46.5 | 1.4 | 1.75 | The Invention |
| Steel IB | Steel I | B | 18.0 | 31.7 | 46.0 | 2.6 | 1.74 | Comparative |
| Steel IC | Steel I | C | 18.3 | 31.8 | 45.8 | 3.7 | 1.74 | Comparative |
| Steel IIA | Steel II | A | 18.6 | 32.3 | 45.7 | 1.5 | 1.30 | The Invention |
| Steel IIB | Steel II | B | 19.0 | 32.8 | 45.1 | 2.7 | 1.31 | Comparative |
| Steel IIC | Steel II | C | 19.5 | 32.8 | 44.8 | 3.7 | 1.30 | Comparative |
| Steel IIIA | Steel III | A | 23.8 | 36.3 | 38.9 | 1.9 | 1.68 | The Invention |
| Steel IIIB | Steel III | B | 24.0 | 36.4 | 38.6 | 2.9 | 1.66 | Comparative |
| Steel IIIC | Steel III | C | 24.2 | 36.5 | 38.4 | 3.8 | 1.70 | Comparative |

As described in detail above, the present invention provides a distinguished continuous annealing process for producing a cold rolled steel sheet having a good ageing resistance through an overageing treatment for a shorter time and has a remarkable economical effect.

What is claimed is:

1. A process for producing a cold rolled steel sheet having good ageing resistance by continuous annealing, which comprises hot rolling steel essentially consisting of 0.010 to 0.06% by weight of C, 0.05 to 0.4% by weight of Mn, 0.002 to 0.025% by weight of S, not more than 0.10% by weight of P, 0.01 to 0.10% by weight of sol. Al, 0.0010 to 0.0060% by weight of N and the balance being iron and inevitable impurities, according to an ordinary hot rolling procedure, thereby making a hot rolled sheet;

cold rolling the hot rolled sheet, thereby making a cold rolled sheet;

subjecting the cold rolled sheet to continuous annealing to cause recrystallization and grain growth;

quenching the steel after the recrystallization and the grain growth, at a cooling rate ($\alpha$) of 50°-250° C./sec from 720°-600° C. to a quenching end temperature ($T_E$) of 200°-310° C.;

reheating the steel sheet after retaining the steel sheet at the $T_E$ temperature for 0 to 15 seconds, by at least 40° C. up to a reheating temperature ($T_R$) of 320°-400° C.;

retaining the $T_R$ temperature of the steel sheet for $t_1$ seconds defined by the following formula (1) or cooling the steel sheet of a rate not more than 0.7° C./sec for $t_1$ seconds defined by the following formula (1);

then cooling the steel sheet at an average cooling rate of not more than 10° C./sec in a temperature zone of not lower than 350° C. in the case where $T_R$ exceeds 350° C., and then cooling the steel sheet in a non-linear inclinatory manner wherein cooling is conducted at an average cooling rate ($C.R_2$) defined by the following formula (2) in a temperature zone of lower than 350° C. to 300° C. and at an average cooling rate ($C.R_3$) defined by the following formula (3) down to 285°-220° C. in a temperature zone of lower than 300° C.:

$$t_s \leqq t_1 \leqq t_h + 20 \quad (1)$$

$$C.R_{2s} \leqq C.R_2 \leqq C.R_{2h} \quad (2)$$

$$C.R_{3s} \leqq C.R_3 \leqq C.R_{3h} \quad (3)$$

wherein:

$$t_s = \frac{1}{(-2.146 \times (1/\alpha) + 0.1211)} \times \exp(0.0130 \times T_E + 25024/(546 + T_R + T_{C1}) - 23.33)$$

$$t_h = \frac{1}{(-2.146 \times (1/\alpha) + 0.1211)} \times \exp(0.0130 \times T_E + 25024/(546 + T_R + T_{C1}) - 22.45)$$

$$C \cdot R_{2s} = (-2.983 \times (1/\alpha) + 0.168) \times \exp(-0.0130 \times T_E + 5.18)$$

$$C \cdot R_{2h} = (-4.185 \times (1/\alpha) + 0.263) \times \exp(-0.0130 \times T_E + 6.06)$$

$$C \cdot R_{3s} = (-0.695 \times (1/\alpha) + 0.0392) \times \exp(-0.0130 \times T_E + 5.18)$$

$$C \cdot R_{3h} = (-1.313 \times (1/\alpha) + 0.0741) \times \exp(-0.0130 \times T_E + 6.06)$$

$t_s$: minimum time for the inclinatory cooling or retaining of the steel sheet at the same temperature, each of which is carried out after the reheating (sec)

$t_h$: maximum time for the inclinatory cooling or retaining of the steel sheet at the same temperature, each of which is carried out after the reheating (sec)

$\alpha$: cooling rate of quenching before the supercooling (°C./sec)

$T_E$: quenching end temperature (°C.)

$T_R$: reheating temperature (°C.)

$T_{C1}$: end temperature of the inclinatory cooling or retaining of the steel sheet at the same temperature, each of which is carried out after the heating (°C.)

$C.R_{2s}$: minimum average cooling rate in the zone of lower than 350° C. to 300° C. (°C./sec)

$C.R_{2h}$: maximum average cooling rate in the zone of lower than 350° C. to 300° C. (°C./sec)

$C.R_{3s}$: minimum average cooling rate in the zone of lower than 300° C.(°C./sec)

$C.R_{3h}$: maximum average cooling rate in the zone of lower than 300° C.(°C./sec).

2. A process according to claim 1, wherein the steel further contains B in a ratio of B/N of 0.5 to 2.0 by weight.

3. A process according to claim 1 or 2, wherein the cooling rate ($\alpha$) of quenching is a rate of 80° to 250° C./sec.

* * * * *

UNITED STATES PATENT AND TRADEMARK OFFICE

CERTIFICATE OF CORRECTION

PATENT NO. : 4,931,107

DATED : June 5, 1990

INVENTOR(S) : Teruaki YAMADA et al.

It is certified that error appears in the above-identified patent and that said Letters Patent is hereby corrected as shown below:

Column 13, line 33, insert --a-- after "having".

Column 13, line 35, insert --a-- after "rolling".

Column 13, line 47, insert --sheet-- after "steel".

Column 13, line 57, change "of" to --at--, and after "rate" insert --of--.

Signed and Sealed this

Eighteenth Day of June, 1991

*Attest:*

*Attesting Officer*

HARRY F. MANBECK, JR.

*Commissioner of Patents and Trademarks*